US005405116A

United States Patent [19]

Shepherd et al.

[11] Patent Number: 5,405,116

[45] Date of Patent: Apr. 11, 1995

[54] WALL BRACKET

[76] Inventors: Charles G. Shepherd, 1008 Westdale Road, Oakville, Ontario, Canada, L6L 5A2; Guenther Kegel, 1350 Winding Trail #75, Mississauga, Ontario, Canada, L4Y 2T8

[21] Appl. No.: 229,740

[22] Filed: Apr. 19, 1994

[51] Int. Cl.[6] ..... A47K 1/08

[52] U.S. Cl. ..... 248/312.1; 47/67

[58] Field of Search ..... 248/312.1, 311.2, 310; 47/67; 211/71, 88

[56] References Cited

U.S. PATENT DOCUMENTS

| | | | |
|---|---|---|---|
| D. 132,368 | 5/1942 | Jorgensen | 47/67 |
| 1,240,908 | 9/1917 | Weis | 248/312.1 X |
| 1,446,036 | 2/1923 | Dodd | 248/312.1 X |
| 2,387,982 | 10/1945 | Demuth | 47/67 X |
| 3,001,753 | 9/1961 | Smith | 248/312.1 X |
| 4,071,218 | 1/1978 | Pecka | 248/312.1 X |
| 4,071,976 | 2/1978 | Chernewski | 248/312.1 X |
| 4,422,610 | 12/1983 | Hunt | 47/67 X |
| 4,841,671 | 6/1989 | Reed | 248/312.1 X |
| 5,074,504 | 12/1991 | Minnick | 47/67 X |

FOREIGN PATENT DOCUMENTS

| | | | |
|---|---|---|---|
| 1424244 | 11/1965 | France | 248/312.1 |
| 2123679 | 2/1984 | United Kingdom | 47/67 |

*Primary Examiner*—J. Franklin Foss
*Attorney, Agent, or Firm*—Mark B. Eisen

[57] ABSTRACT

An adjustable mounting bracket for mounting a flower pot on a wall comprises a mounting plate and a leg supported by the mounting plate for supporting the flower pot. The leg is supported in one of a series of transverse slots in the mounting plate. Rim hooks are slidably mounted in a vertical slot in an upper portion of the mounting plate and a vertical slot in the leg, for engaging the rim of the flower pot and a drainage tray, respectively.

8 Claims, 4 Drawing Sheets

WALL BRACKET

FIELD OF INVENTION

This invention relates to mounting brackets. In particular, this invention relates to an adjustable wall bracket for mounting a flowerpot on a wall or other vertical surface.

BACKGROUND OF THE INVENTION

Flowerpots for potted plants are conventionally made from ceramic or plastic molded or formed into a frustoconical shape, with a drainage hole in the bottom to prevent injury to the plant from overwatering. The flowerpot typically nests in a shallow drainage basin, which serves to catch excess water that filters through the medium (for example potting soil) and out the drainage hole, and thus prevents soiling or damage to a floor, table or other structure upon which the plant is supported.

This configuration of flowerpot presents difficulties in mounting on a vertical surface, due to the frustoconical shape of the flowerpot and the need to also support a detached drainage basin underneath the flowerpot. A simple wall bracket is unsuitable; the wall bracket must be made to accommodate the sloping side wall of the flowerpot and to support the drainage basin, in such a way that the flowerpot is supported vertically with the basin properly positioned underneath it to catch any overflow of water.

The support must be sturdy, considering the weight of the filled flowerpot, particularly if the flowerpot is mounted outdoors and thus subjected to wind and rain. Moreover, flowerpots of this type come in a variety of sizes, and a conventional wall bracket cannot be adjusted to accommodate varying sizes of flowerpots.

The present invention overcomes these problems by providing a mounting bracket for mounting a flowerpot and its drainage basin on a vertical surface. The bracket is configured to accommodate the frustoconical shape of the flowerpot and to properly position the drainage basin underneath it. Furthermore, the bracket is adjustable to provide sturdy support to flowerpots of various sizes.

SUMMARY OF THE INVENTION

The present invention thus provides a mounting on a vertical surface, a pot having a rim around a top opening and a drainage basin having a rim around a top opening, comprising a mounting channel having a back and sides, the back being provided with a vertical slot in an upper portion thereof and a series of openings in a lower portion thereof, a detachable leg having a foot for supporting the drainage basin and means for engaging one of the openings in the back of the channel, the leg being provided with a vertical slot, and engaging means slidably engaged to the vertical slots to engage the rims of the flowerpot and the drainage basin.

BRIEF DESCRIPTION OF THE DRAWINGS

In drawings which illustrate by way of example only a preferred embodiment of the present invention.

DETAILED DESCRIPTION OF THE INVENTION

Figure 1:
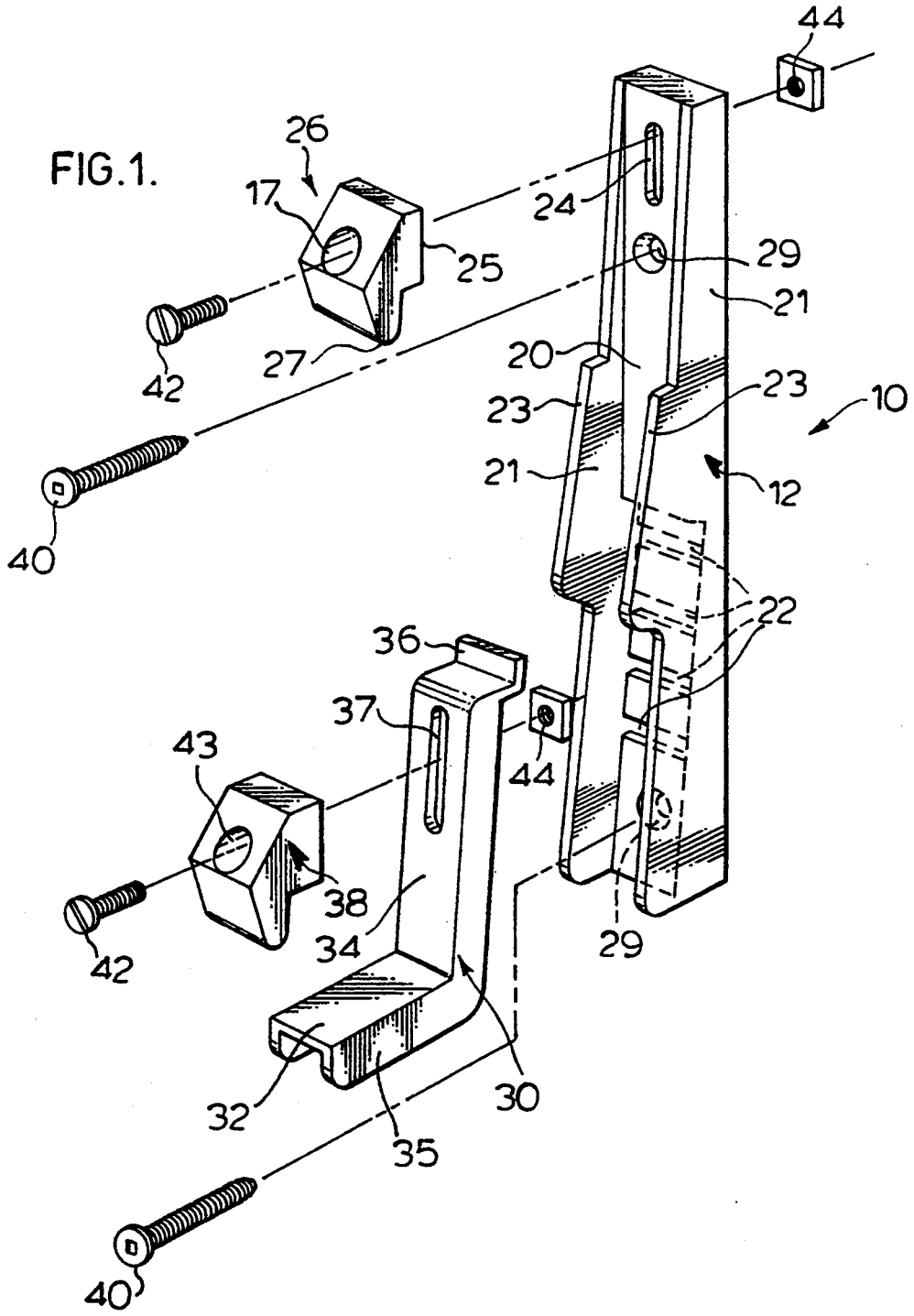
FIG. 1 is an exploded perspective view of the bracket of the invention.

Referring to FIG. 1, the bracket; 10 comprises a mounting channel 12 having a back 20 and sides 21. Each side 21 is provided with a sloped edge portion 23 complementary to the sloping wall 4 of a frustoconical flowerpot 2, shown in FIGS. 5 and 6. A lower portion of the back 20 is provided with a series of openings, in the preferred embodiment transverse slots 22, for mounting a leg 30. An upper portion of the back 20 is provided with a vertical slot 24 for attaching means for engaging the rim 6 of flowerpot, comprising in the preferred embodiment a rim hook 26 formed from a block of plastic or metal having a lip 27 and a flat back surface 25, with a hole 17 for the passage of a bolt 42 therethrough. A countersunk screw hole 29 is provided in each of the upper and lower portions of the back 20, for securing the mounting plate 12 to a wall 1 or other vertical surface.

The bracket 10 is preferably formed from metal or strong plastic, or a combination of these materials. The only limitation in the materials used is that the bracket must be able to support the weight of the filled flowerpot without deforming or cracking.

Figure 2:
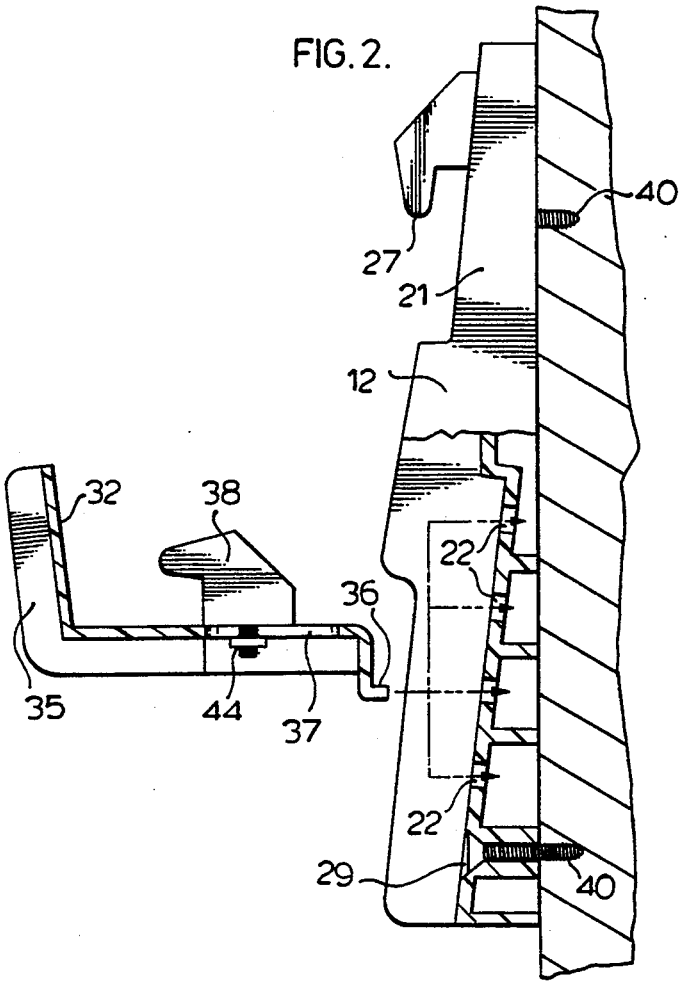
FIG. 2 is a partially cutaway side elevation showing the manner of insertion of the leg.
Figure 3:
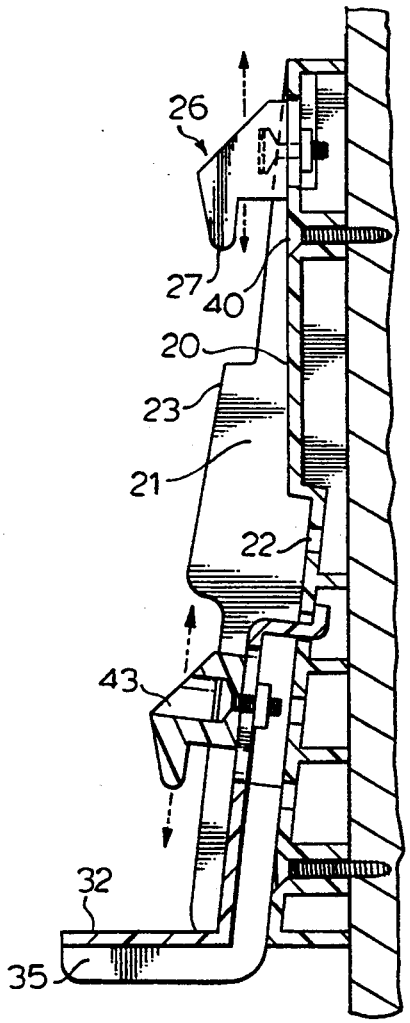
FIG. 3 is a cross sectional elevation showing the direction of movement of the rim hooks.

The sides 21 extend rearwardly of the back 20, as seen in FIGS. 2 and 3, so that when the mounting channel 12 is secured to a wall 1 there is a space between the back 20 and the wall 1 to allow a clearance for a nut 44 and the hooked flange 36 of the leg 30, as described below. Preferably the sides 21 trap the nut 44 behind the slot 24, so that the nut 44 will not turn as the bolt 42 securing the rim hook 26 to the slot 24 is tightened. This facilitates loosening and tightening of the rim hook 26 in the slot 24, since the nut 44 is not accessible once the mounting channel 12 has been fastened to a wall.

The leg 30 comprises a foot 32 for supporting the drainage tray 7, extending orthogonally from the bottom of a vertical member 34. The vertical member 34 terminates at its upper end in means for engaging the slots 22, comprising a hooked flange 36 that mates with one of the slots 22 in the back wall 20. The vertical member 34 is provided with a vertical slot 37 for securing a second rim hook 38 using a bolt 42 through the hole 43.

The leg 30 is preferably formed with reinforcing side flanges 35 for increased strength. Preferably the side flanges 35 trap the nut 44 behind the slot 37, preventing the nut 44 from turning as the bolt 42 is tightened. As in the case of the rim hook 26, this facilitates loosening and tightening of the rim hook 38 in the slot 37.

Figure 5:
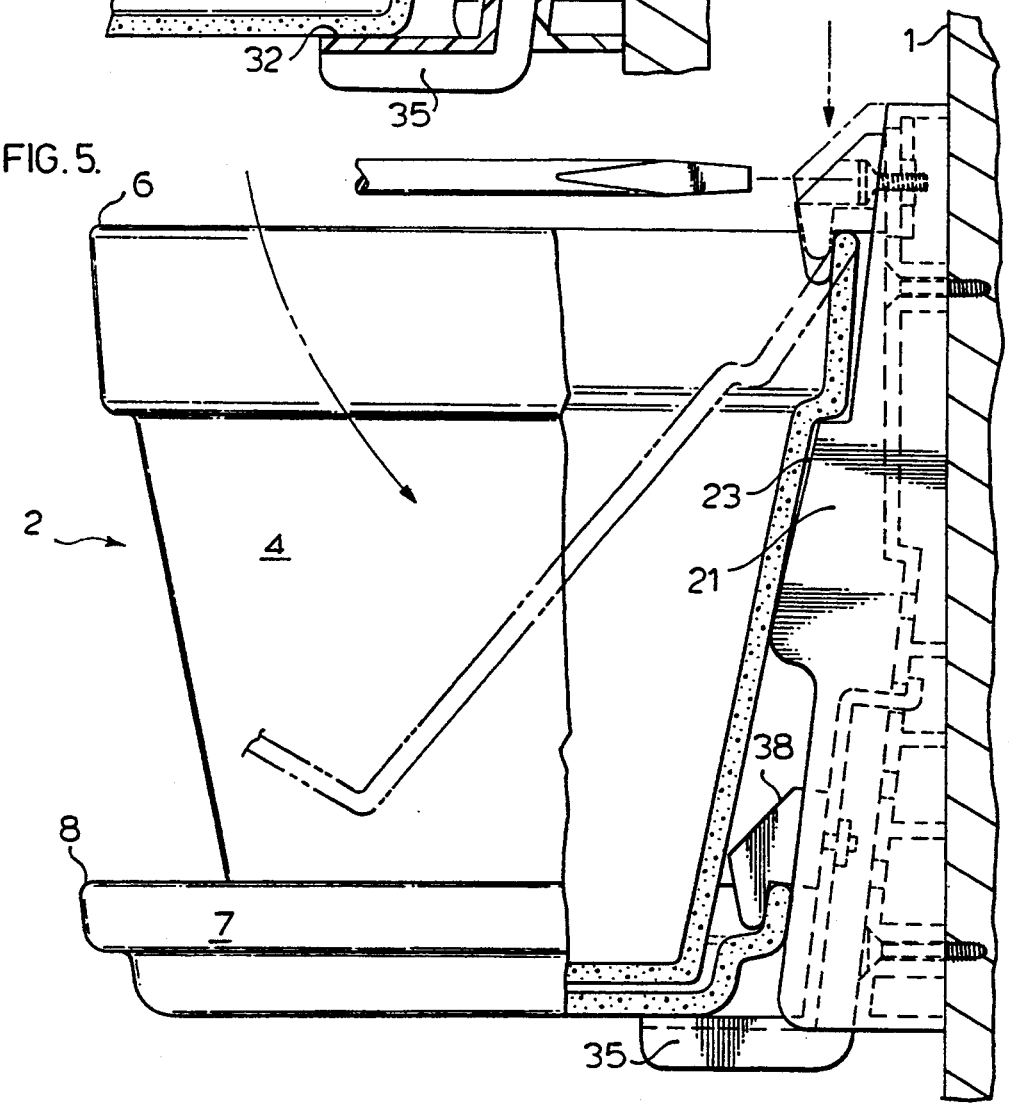
FIG. 5 is a cross sectional elevation showing the manner of mounting the flowerpot.

Preferably the width of the leg 30 is such that it will fit between the sides 21 of the mounting channel 12 so that it rests against the back 20 of the mounting channel 12 when the drainage tray 7 is mounted thereon (see FIG. 3). The rim hook 26 should also fit between the sides 21, so as to engage tightly against the back 20 when the bolt 42 is tightened. The lip 27 should be spaced from the rear face 25 of the rim hook 26 just enough to allow the rim 6 of the flowerpot 2 to be trapped between the lip 27 and the sides 21 of the mounting channel 12, as shown in FIG. 5. The rim hook 38 may be identical to the rim hook 26, to reduce costs of manufacture.

In use, the rim hook 26 is bolted to the mounting channel 12 through the slot 24 and the rim hook 38 is bolted to the leg 30 through the slot 37. The bolts are not tightened, so the rim hooks 26,38 can slide vertically in their respective slots 24,37. The mounting channel 12 is then fastened to a wall 1 or other vertical surface in a conventional fashion using screws 40 or another fastening means.

Figure 4:
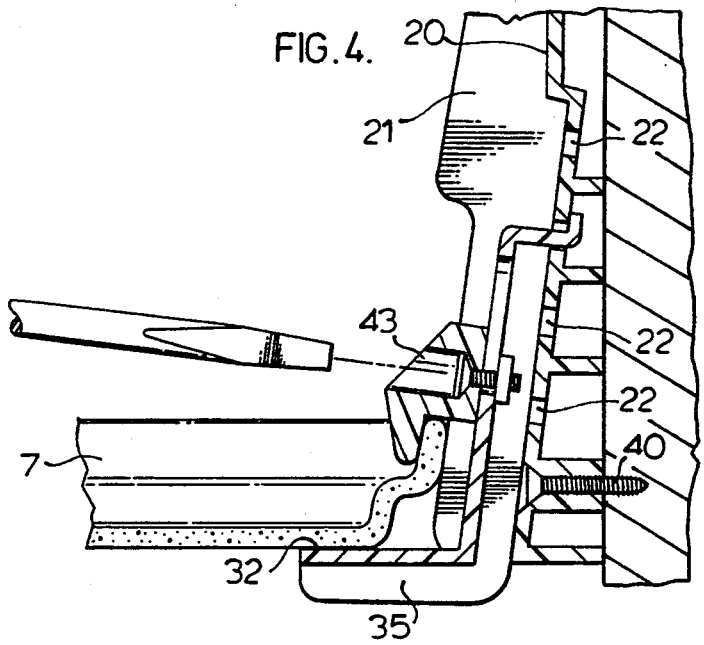
FIG. 4 is a partial cross section showing the manner of mounting the drainage basin.

The hooked flange 36 of the leg 30 is inserted into a slot 22 in the back 20 of the mounting channel 12, as shown in FIG. 2, the slot 22 being chosen according to the height of the flowerpot 2. The rim hook 38 is lifted as the drainage tray 7 is placed on the foot 32. The rim hook 38 is then lowered over the rim 8 of the drainage tray and the bolt 42 is tightened, as shown in FIG. 4.

The flowerpot 2 is mounted by lifting the rim hook 26 and swinging the flowerpot 2 down into position seated in the drainage tray 7, as shown in FIG. 5. The rim hook 26 is lowered over the rim 6 of the flowerpot 2 and the bolt 42 is tightened.

Figure 6:
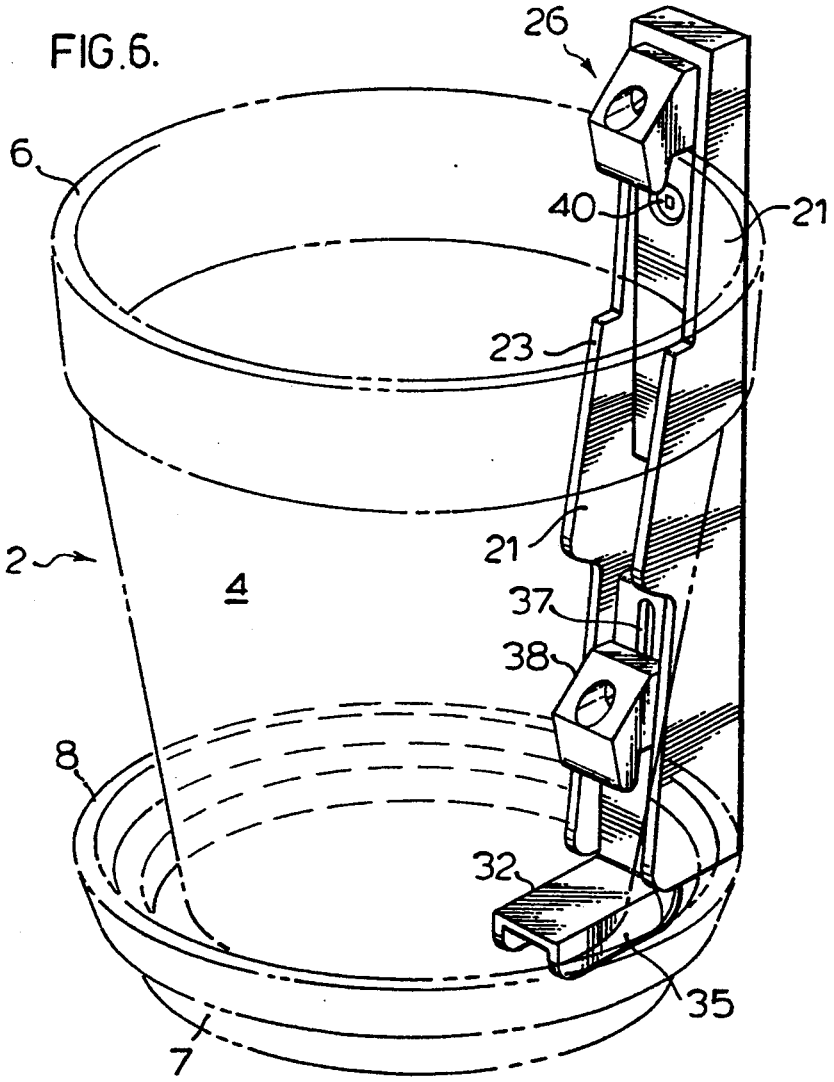
FIG. 6 is a perspective view of the bracket with the flowerpot and drainage basin mounted in position.

The drainage tray 7 is thus supported on the foot 32 and held in place by the rim hook 38, while the flowerpot 2 is supported by the drainage tray 7 and held in place by the rim hook 26, as shown in FIG. 6. The sloping edge portions 23 of the sides 21 of the mounting channel 12 help to keep the flowerpot 2 oriented vertically.

It can thus be seen that the mounting bracket 10 of the present invention can be adjusted to mount a flowerpot 2 of virtually any size, the range of possible sizes being limited only by the number of transverse slots 22 in the back 20 of the mounting channel 12. The slots 22 are spaced in increments which accommodate anticipated differences in the heights of various flowerpots, while the vertical slot 24 allows for fine adjustments to accommodate small differences in height. Accordingly, for maximum versatility the spacing between the slots 22 should be no greater than the length of the vertical slot 24.

The invention having thus been described with reference to a preferred embodiment thereof, it will be obvious to those skilled in the art that certain modifications and adaptations may be made without departing from the scope of the invention as set out in the claims appended hereto.

We claim:

1. A mounting bracket for mounting on a vertical surface a pot having a rim around a top opening and a drainage basin having a rim around a top opening, comprising a mounting channel having a back and sides, the back being provided with a vertical slot in an upper portion thereof and a series of openings in a lower portion thereof, a detachable leg having a foot for supporting the drainage basin and means for engaging one of the openings in the back of the channel, the leg being provided with a vertical slot, and engaging means slidably engaged to the vertical slots to engage the rims of the flowerpot and the drainage basin.

2. The mounting bracket of claim 1 in which an upper end of the leg terminates in a hooked flange for engaging one of the openings in the back of the mounting channel.

3. The mounting bracket of claim 1 in which the sides of the mounting channel extend rearwardly of the back, leaving a clearance between the back and the vertical surface.

4. The mounting bracket of claim 1 in which the engaging means comprises a block having a lip for engaging the rim of the flowerpot or the drainage basin.

5. The mounting bracket of claim 4 in which the block is engaged to the vertical slot in the back of the mounting channel by a bolt and nut, wherein the nut is trapped between the sides of the mounting channel.

6. The mounting bracket of claim 4 in which the leg is provided with side flanges and the block is engaged to the vertical slot in the leg by a bolt and nut, wherein the nut is trapped between the side flanges of the leg.

7. The mounting bracket of claim 1 in which at least one side of the mounting channel is provided with an inclined edge portion complementary to the inclination of a wall of the flowerpot.

8. The mounting bracket of claim 7 in which both sides of the mounting channel are provided with inclined edge portions.

* * * * *